US012352041B2

(12) United States Patent
Dupont-Madinier et al.

(10) Patent No.: US 12,352,041 B2
(45) Date of Patent: Jul. 8, 2025

(54) LIGHTWEIGHT BUILDING ASSEMBLY

(71) Applicant: Kim Dupont-Madinier, Miami, FL (US)

(72) Inventors: Kim Dupont-Madinier, Miami, FL (US); John Strauss, Rindge, NH (US); Jon Knowles, Providence, RI (US)

(73) Assignee: Kim Dupont-Madinier, Miami, FL (US)

( * ) Notice: Subject to any disclaimer, the term of this patent is extended or adjusted under 35 U.S.C. 154(b) by 301 days.

(21) Appl. No.: 18/138,519

(22) Filed: Apr. 24, 2023

(65) Prior Publication Data

US 2023/0340779 A1 Oct. 26, 2023

Related U.S. Application Data

(60) Provisional application No. 63/334,043, filed on Apr. 22, 2022.

(51) Int. Cl.
*E04B 1/76* (2006.01)

(52) U.S. Cl.
CPC ..... *E04B 1/7616* (2013.01)

(58) Field of Classification Search
CPC ... E04B 1/3205; E04B 1/7616; F24F 13/0227
See application file for complete search history.

(56) References Cited

U.S. PATENT DOCUMENTS 4,036,244 A * 7/1977 Huddle ..... E04H 15/40 52/63
4,092,992 A * 6/1978 Huddle ..... E04H 15/36 52/642
4,324,074 A * 4/1982 South ..... E04B 1/3505 264/45.2
4,593,710 A * 6/1986 Stafford ..... E04H 15/644 52/63
4,887,397 A * 12/1989 Peterson ..... E04H 15/36 52/108
5,181,352 A * 1/1993 Friedman ..... E04H 15/18 52/63
5,335,684 A * 8/1994 Hanninen ..... E04H 15/505 135/156

(Continued)

*Primary Examiner* — Joshua K Ihezie
(74) *Attorney, Agent, or Firm* — Cognition IP, P.C.; Edward Steakley; Justin White

(57) ABSTRACT

A lightweight building assembly can include an insulation blanket, an insulation base, a frame, and tensioned elements. The insulation blanket can define an insulation blanket axis about which the insulation blanket can rotate. The insulation blanket can have a peripheral wall portion positioned at a varying radial distance from the insulation blanket axis. The insulation base can have a first membrane and can be coupled to and support the insulation blanket. The frame can have a second membrane and can be coupled to and support the insulation base. The frame can be configured to move with respect to the insulation base. The tensioned elements can be wound about the insulation blanket, and each tensioned element can extend tangentially from the peripheral wall portion to the second membrane. The tensioned elements can combine to form a continuous tension circuit across the assembly, which assembly can be effective in multiple disparate climates.

21 Claims, 7 Drawing Sheets

(56) References Cited

U.S. PATENT DOCUMENTS

| | | | | |
|---|---|---|---|---|
| 5,918,438 | A * | 7/1999 | South | E04B 1/3211 52/80.1 |
| 6,840,013 | B2 * | 1/2005 | South | E04B 1/3211 52/80.1 |
| 8,297,282 | B2 * | 10/2012 | Holley | E04H 3/14 482/148 |
| 11,053,677 | B2 * | 7/2021 | Huang | E04H 15/20 |
| 2017/0051502 | A1 * | 2/2017 | Wolf | E04B 1/7666 |
| 2020/0208399 | A1 * | 7/2020 | Keller | E04B 7/024 |
| 2023/0340779 | A1 * | 10/2023 | Dupont-Madinier | F24F 13/0227 |

* cited by examiner

LIGHTWEIGHT BUILDING ASSEMBLY

CROSS-REFERENCE TO RELATED APPLICATIONS

This application claims priority to U.S. Provisional Patent Application No. 63/334,043, filed Apr. 22, 2022, which is hereby incorporated by reference in its entirety.

TECHNICAL FIELD

The present disclosure relates generally to construction, and more particularly to building structure components and assemblies.

BACKGROUND

There are presently numerous challenges in the construction industry to provide building components and assemblies in a various applications and environments. In traditional construction practices, building structures are formed on site in layers of different materials. The types of materials used and the way that building layers are formed are typically based on the climate where a building is being constructed. Different environments and climate types can result in the need for entirely different types of building materials and construction techniques.

Unfortunately, this tends to result in a lack of flexibility with respect to any given set of building materials or components, as one set of building components may be suitable for an arid climate but not for a humid climate. Some climates may even require heavy and inflexible building materials. Furthermore, typical layered up construction techniques can be labor intensive, time consuming, and inflexible, with different sets of building components needing to be worked up on site to form a given structure. Although some forms of prefabricated building components do exist, these can be limited to certain environments and are not easily transported.

Although traditional ways of providing building structures have worked in the past, improvements are always helpful. In particular, what is desired are new building structures that are modular, flexible, lightweight, readily transportable, easily installed within an overall building structure, and configured to be used in any climate or environment.

SUMMARY

It is an advantage of the present disclosure to provide new building structures that are modular, flexible, lightweight, readily transportable, easily installed within an overall building structure, and configured to be used in any climate or environment. The disclosed features, apparatuses, systems, and methods provide lightweight building assemblies that can be used to form walls, roofs, floors, and other pertinent sections of an overall building structure. The foregoing advantages can be accomplished at least in part by lightweight building assemblies having insulation arrangements uniquely arranged within a structural framework, as well as tensioned elements that wrap around the assembly to hold the assembly together while allowing the assembly to be compressed, expanded, and flexibly arranged into a variety of shapes.

In various embodiments of the present disclosure, a lightweight building assembly can include an insulation blanket, an insulation base, a frame, and a plurality of tensioned elements. The insulation blanket can define an insulation blanket axis about which the insulation blanket is configured to rotate. Also, the insulation blanket can have a peripheral wall portion positioned at a radial distance from the insulation blanket axis, and the radial distance can vary along a length of the insulation blanket axis. The insulation base can be coupled to and configured to support the insulation blanket, and the insulation base can have a first membrane. The frame can be coupled to and configured to support the insulation base, and the frame can have a second membrane. Also, the frame can be configured to move with respect to the insulation base. The plurality of tensioned elements can be situated about the insulation blanket, and the each of the tensioned elements can extend tangentially from the peripheral wall portion of the insulation blanket to the second membrane. The plurality of tensioned elements can combine to form a continuous tension circuit across the lightweight building assembly.

In various detailed embodiments, the lightweight building assembly can be configured to be effective in multiple disparate climates. Such disparate climates can include an arid climate, a humid climate, a hot climate, a cold climate, and a hurricane zone. The insulation blanket can include an insulation material wrapped in a sealed membrane. The sealed membrane can be aluminum based in some arrangements. The insulation base can also include an insulation material wrapped in a sealed membrane, which sealed membrane can also be aluminum based. In various arrangements, the first membrane can be weatherproof and fire rated, and the second membrane can include a vapor opening and can be fire rated. The plurality of tensioned elements can be woven ratchet straps, among other possible materials, and can be coupled to the insulation base. In various embodiments, a first ventilation channel can be formed between the first membrane and the insulation blanket. In addition, a second ventilation channel can be formed between the second membrane and the insulation blanket.

In further embodiments of the present disclosure, various methods of operating a lightweight building assembly are provided. Pertinent process steps can include ventilating on either side of an insulation blanket, ventilating between a first membrane and the insulation blanket, and ventilating between a second membrane and the insulation blanket. The insulation blanket can be part of a lightweight building assembly that also includes at least an insulation base, a frame, and a plurality of tensioned elements. The insulation blanket can define an insulation blanket axis about which the insulation blanket is configured to rotate. Also, the insulation blanket can have a peripheral wall portion positioned at a radial distance from the insulation blanket axis, wherein the radial distance varies along a length of the insulation blanket axis. The insulation base can be coupled to and configured to support the insulation blanket, and the insulation base can have the first membrane. The frame can be coupled to and configured to support the insulation base, and the frame can have the second membrane. Also, the frame can be configured to move with respect to the insulation base. The plurality of tensioned elements can be wound about the insulation blanket, and each of the plurality of tensioned elements can extend tangentially from the peripheral wall portion of the insulation blanket to the second membrane.

In various detailed embodiments, one or more of the ventilating steps can involve the use of a fan, a wall shape, an airfoil, an electrical current, and/or any other suitable component or arrangement to facilitate airflow. Additional process steps can include using the insulation blanket, wherein the insulation blanket is insulated and airtight, providing a continuous tension circuit across the lightweight building assembly, and protecting the lightweight building assembly from external conditions.

In still further embodiments of the present disclosure, various methods of installing a lightweight building assembly are provided. Pertinent process steps can include providing an insulation blanket, coupling an insulation base having a first membrane to the insulation blanket, coupling a frame to the insulation base, installing a plurality of tensioned elements, and installing a second membrane to the frame. The insulation blanket can define an insulation blanket axis about which the insulation blanket is configured to rotate. Also, the insulation blanket can have a peripheral wall portion positioned at a radial distance from the insulation blanket axis, and the radial distance can be configured to vary along a length of the insulation blanket axis. The frame can be coupled to the insulation base such that the frame is configured to move with respect to the insulation base. The plurality of tensioned elements can be installed about the insulation blanket such that the each of the plurality of tensioned elements extends tangentially from the peripheral wall portion of the insulation blanket. The second membrane can be installed to the frame such that the second membrane is at a distance above a floor of the overall building structure.

In various detailed embodiments, the plurality of tensioned elements can combine to form a continuous tension circuit across the lightweight building assembly. Installing the plurality of tensioned elements can involve coupling the tensioned elements to the insulation base. Also, the lightweight building assembly can be configured to be effective in multiple disparate climates. In some arrangements, an additional process step can involve rotating the insulation blanket about an insulation blanket axis.

Other apparatuses, methods, features, and advantages of the disclosure will be or will become apparent to one with skill in the art upon examination of the following figures and detailed description. It is intended that all such additional apparatuses, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures and arrangements for the disclosed apparatuses, systems and methods of use regarding lightweight building assemblies. These drawings in no way limit any changes in form and detail that may be made to the disclosure by one skilled in the art without departing from the spirit and scope of the disclosure.

DETAILED DESCRIPTION

Figure 1:
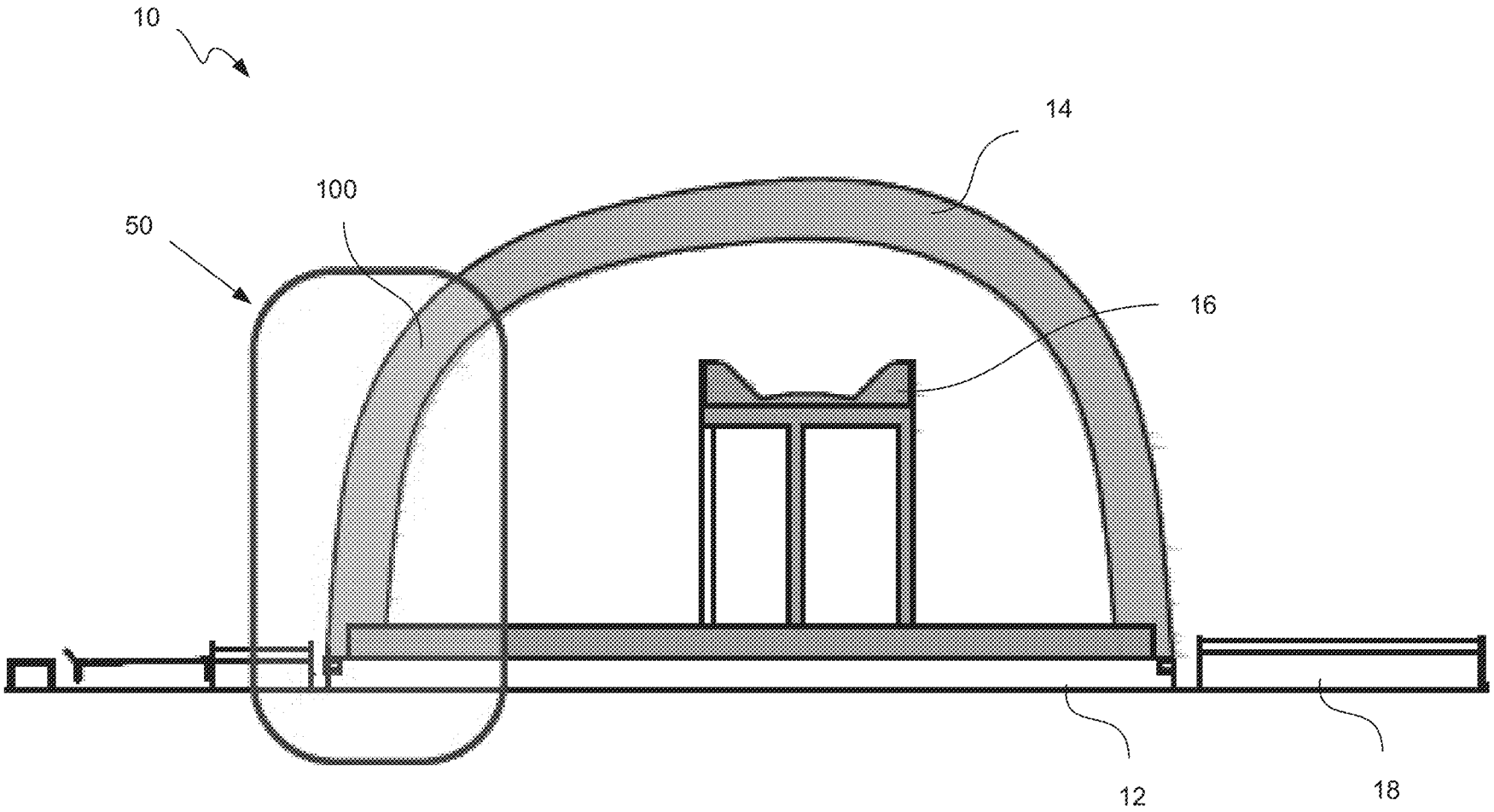
FIG. 1 illustrates in side cross-section view an example overall building structure having a lightweight building assembly within a wall region according to one embodiment of the present disclosure.

Exemplary applications of apparatuses, systems, and methods according to the present disclosure are described in this section. These examples are being provided solely to add context and aid in the understanding of the disclosure. It will thus be apparent to one skilled in the art that the present disclosure may be practiced without some or all of these specific details provided herein. In some instances, well known process steps have not been described in detail in order to avoid unnecessarily obscuring the present disclosure. Other applications are possible, such that the following examples should not be taken as limiting. In the following detailed description, references are made to the accompanying drawings, which form a part of the description and in which are shown, by way of illustration, specific embodiments of the present disclosure. Although these embodiments are described in sufficient detail to enable one skilled in the art to practice the disclosure, it is understood that these examples are not limiting, such that other embodiments may be used, and changes may be made without departing from the spirit and scope of the disclosure.

The present disclosure relates in various embodiments to features, apparatuses, systems, and methods for lightweight building assemblies. The disclosed embodiments generally provide easy to deploy well insulated building structures that are climate dominant in that they can operate effectively in a variety of disparate climates. The disclosed structures are lightweight, strong, reliable, and thermally advantageous assemblies for overall building structures. The disclosed structures can also be readily transported and are flexible such that they can be installed into overall building structures in a variety of shapes and configurations.

These advantages can be accomplished at least in part by providing an insulation blanket within one or more membranes, tensioned elements, an insulation base, and a frame, among other components. The insulation blanket and membrane combination can act as a thermal, air, and moisture barrier in any climate or environment. The tensioned elements can be wound along an axis of the insulation blanket that is located at a varying distance radially outward from the insulation blanket. These tensioned elements can form a continuous envelope circuit around the structure that provides structural rigidity to the lightweight building assembly while also providing the assembly with the flexibility to allow installation in a variety of different shapes. An insulation base coupled to the insulation blanket can include membranes and a frame to support the insulation blanket in some arrangements.

Although various embodiments disclosed herein discuss the provided lightweight building assemblies as wall and roof assemblies for a dwelling for purposes of illustration, it will be readily appreciated that the disclosed features, apparatuses, systems, and methods can similarly be used for other purposes as may be desired. For example, the disclosed embodiments may also be arranged to form all or parts of ceilings, floors, doors, partitions, and other structural components. In addition to dwellings, the disclosure lightweight building assemblies can also be used for offices, retail shops, warehouses, and other types of buildings. Other applications, arrangements, and extrapolations beyond the illustrated embodiments are also contemplated.

Referring first to FIG. 1, an example overall building structure having a lightweight building assembly within a wall region is illustrated in side cross-section view. Overall building structure 10 can include various well-known structural features, such as, for example, a floor 12, a roof 14, one or more doors 16, and an outside porch 18 or other structure abutting element, among other possible structural features. Overall building structure 10 can also include one or more walls 100 or wall regions. Such walls 100 or wall regions can be integrally formed with the roof 14 in some arrangements. Wall 100 is shown within highlighted region 50, which will be discussed in greater detail below with respect to FIGS. 2 and 3.

Figure 2:
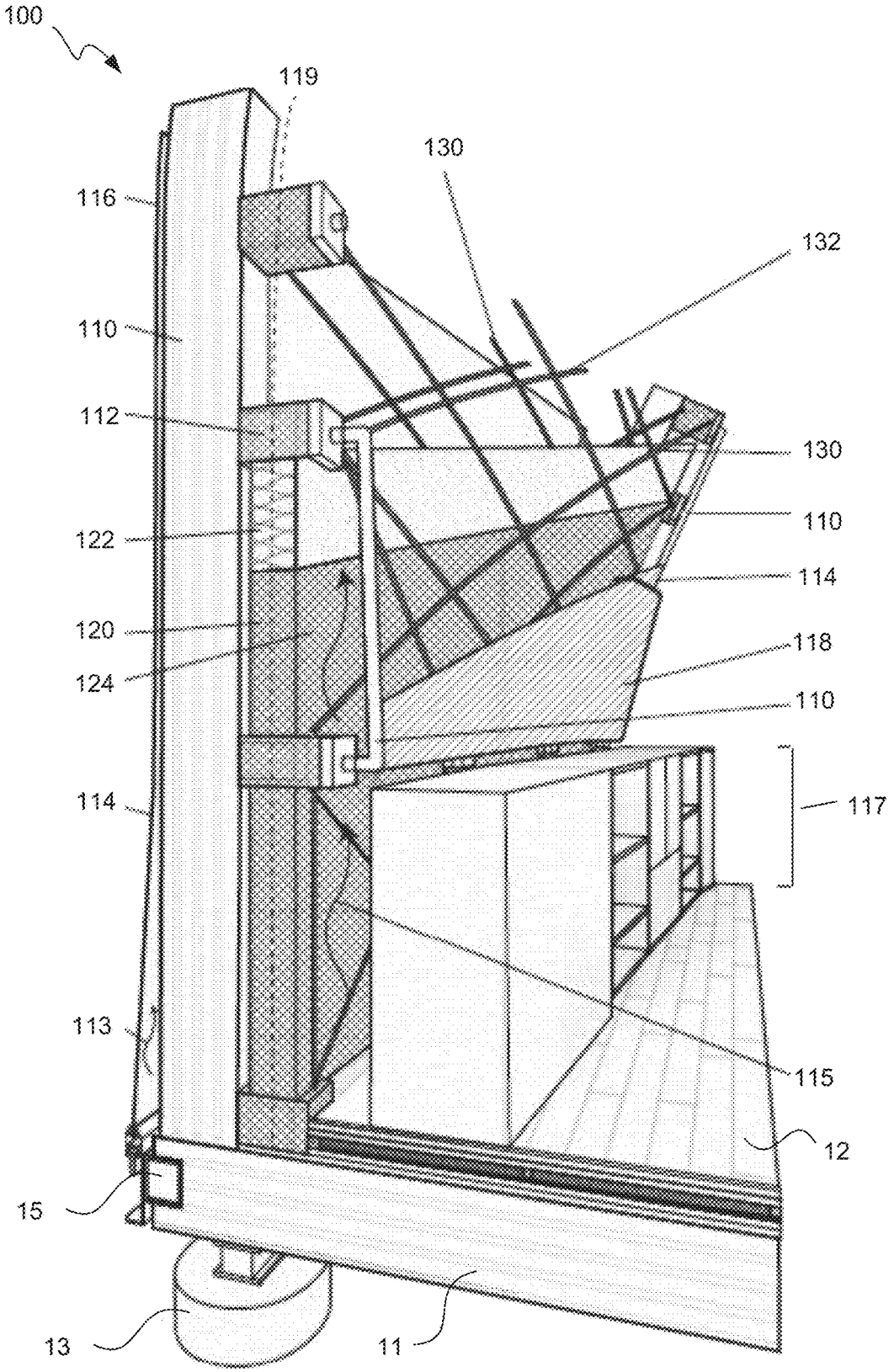
FIG. 2 illustrates in perspective cross-section view an example wall region of the overall structure of FIG. 1 according to one embodiment of the present disclosure.
Figure 3:
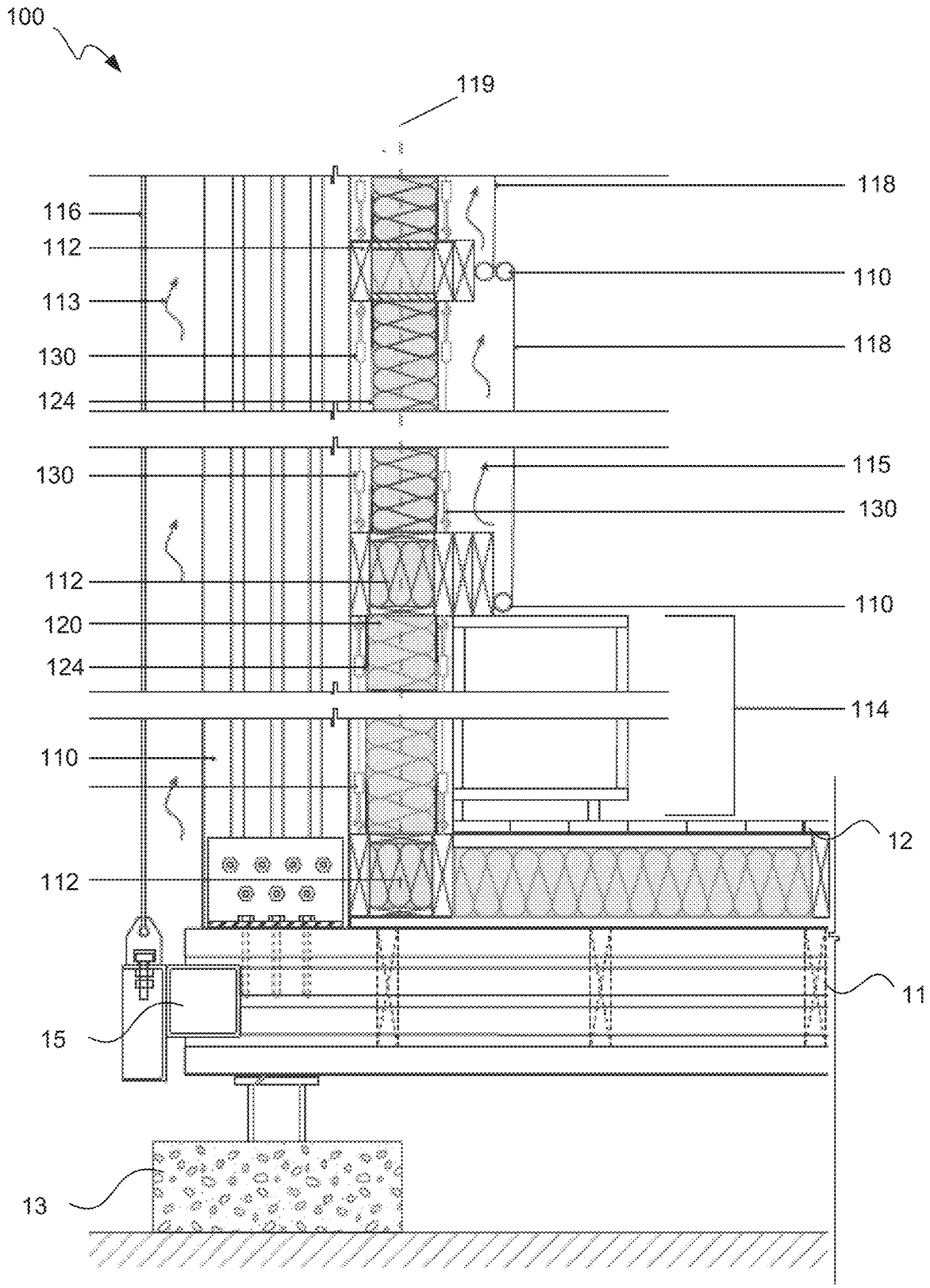
FIG. 3 illustrates in side cross-section view the wall region of FIG. 2 according to one embodiment of the present disclosure.

Continuing with FIGS. 2 and 3, an example wall region of the overall building structure of FIG. 1 is shown in perspective cross-section and side cross-section views respectively. The example wall region as shown is a floor to wall section that can represent an off the grid housing topology, for example, and can leverage advanced materials to achieve a climate dominant performance. That is, the disclosed structure can be used effectively in virtually any type of climate, such as an arid climate, a humid climate, a hurricane zone, hot, cold, or any other extreme climate on earth or any other location. Again, the overall building structure can include a variety of well-known structural elements, such as, for example, a floor 12, subfloor 11, foundational elements 13, and a subfloor support beam 15, among other basic structural elements. At least a portion of wall 100 can include a lightweight building assembly that is modular, flexible, compressible, expandable, readily transportable, and readily installable into an overall building structure.

Various components of the lightweight building assembly can include frame 110 and insulation base 112, which together provide an overall structural framework for the lightweight building assembly. Frame 110 can provide the primary structural support for the assembly and can facilitate integration of the assembly into an overall building structure. In various embodiments, frame 110 can be formed from a lightweight but rigid wood, composite, or metal material, for example, although other materials can alternatively be used. Insulation base 112 can couple to frame 110 and can be used to support other structural components within the assembly. In various embodiments, insulation base 112 can include spaced apart blocks having end caps to facilitate structural connections and rigidity. Various assembly components can then attach to the end caps of insulation base 112. Insulation base 112 can also be formed from a lightweight but rigid wood, composite, or metal material, for example. In a particular non-limiting example, the blocks of insulation base 112 can be formed of a plywood material with an insulated core, while the endcaps can be formed of a nylon material.

Peripheral wall portion 114 can be the outermost portions of the wall visible on the outside of the structure. Peripheral wall portion 114 can be an exterior rain barrier formed of a high performance textile material, and can be fabric, cloth, plastic, or any other suitable material. Together, frame 110, insulation base 112, and peripheral wall portion 114 can combine to form internal framework and outside surface elements of the lightweight building assembly. First membrane 116 can be a membrane disposed between peripheral wall portion 114 and insulation base 112 at an exterior region of the lightweight building assembly, while second membrane 118 can be a membrane disposed between peripheral wall portion 114 and insulation base 112 at an exterior region of the lightweight building assembly. In various arrangements, an offset 117 can be formed between the bottom of second membrane 118 and the ground or floor of the overall building structure. Such an offset 117 can function to limit dirt or debris from accumulating on second membrane 118. Offset 117 can be about two to three feet, although other distances are also possible.

The lightweight building assembly can also include an arrangement of insulation components located within this structure formed by frame 110, insulation base 112, and peripheral wall portion 114. Insulation blanket 120 can have insulation material 122 sealed inside insulation blanket membrane 124. Insulation material 122 can be fiberglass, aerogel, or any other suitable insulation material, for example. Insulation blanket membrane 124, which encloses insulation material 122 inside insulation blanket 120, can be a nonpermeable airtight and moisture resistant membrane formed of any suitable material, such as a sheet material. Insulation blanket membrane 124 can be coated in aluminum or another suitable material such that it wicks moisture away from the insulation blanket. In a particular non-limiting example, insulation blanket membrane 124 can be an Airshield or Henry membrane.

In various embodiments, insulation blanket 120 having insulation material 122 inside blanket membrane 124 can be a preassembled unit that can be installed together within the lightweight building assembly. For example, frame 110 and insulation base 112 can be formed to provide an overall structure for the lightweight building assembly, and then insulation blanket 120 can be installed as a preformed component within the frame and insulation base. Insulation blanket 120 can attach to the blocks of insulation base 112, for example.

Insulation blanket 120 can define an insulation blanket axis 119 about which the insulation blanket is configured to rotate. The insulation blanket, which can also include the peripheral wall portion 114, can be positioned at a radial distance from the insulation blanket axis 119. Depending on the overall shape formed by the installed insulation blanket 120, the radial distance can vary along a length of the insulation blanket axis 119.

After insulation blanket 120 is installed, a plurality of tensioned elements 130 can then be installed around the insulation blanket by coupling the tensioned elements to insulation base 112. Insulation blanket 120 can be flexible, such that it can be formed into any desired shape. This plurality of tensioned elements 130 can allow the lightweight building assembly to be compressed to facilitate easy transport and expanded during construction to form a wall portion, roof portion, or other building component. Tensioned elements 130 are also flexible so to facilitate the ability to shape insulation blanket 120 therewith and form the overall lightweight building assembly into a variety of different shapes, such as curved, straight, or other shapes. The plurality of tensioned elements 130 can combine to form a continuous tension circuit 132 across the lightweight building assembly. Such a continuous tension circuit 132 can function to hold insulation blanket 120 in place within the lightweight building assembly.

Tensioned elements 130 can be formed of any suitable lightweight, strong, and flexible material, such as, for example, fabric, plastic, rubber, or the like. In a particular non-limiting example, tensioned elements 130 can be fabric ratchet straps. A flexible material is preferable over rigid poles or similar structural materials in order to provide greater flexibility and lighter weight. In various arrangements, the plurality of tensioned elements 130 can be attached to the blocks of insulation base 112 to form a woven grid on the inside and outside of the insulation system so that it can take on any shape. This combination of components can function similar to a corset system in that tensioned elements 130 can be loose or saggy prior to and during installation, and tension can then be applied to tighten the system and provide an overall desired shape to the lightweight building assembly.

When installed, the lightweight building assembly can include one or more ventilation channels that provide airflow about the assembly. For example, a first ventilation channel 113 toward the exterior of the lightweight building assembly can provide airflow between first membrane 116 and insulation blanket 120. Similarly, a second ventilation channel 115 toward the interior of the lightweight building assembly can provide airflow between second membrane 118 and insulation blanket 120. Additional ventilation or airflow channels are also possible. Ventilation channels can form a gap or passage of about 8 inches in some arrangements, although other dimensions are also possible. Airflow channels 113, 115 can facilitate an even thermal distribution across the lightweight building assembly by passing air therethrough and transferring heat away from any localized hotspots. In various arrangements, airflow through ventilation channels 113, 115 can be facilitated by one or more fans, wall shapes, airfoils, electrical currents and/or other suitable devices to draw or push air through the channels.

In various embodiments, some or all of the foregoing materials in the disclosed lightweight building assembly can be fire rated, such as at a class A, M1, or M0 designation. Some or all of the membranes and other components can also be hurricane or wind resistant at wind speeds of up to 130 mph or more. In addition to the foregoing components disclosed for a modular and readily portable and installable lightweight building assembly, other components may also be included. For example, sensors can be installed within the assembly to measure building performance in a variety of ways. One or more processors may also be included in conjunction with such sensors to detect assembly issues and provide warnings or alerts. Other types of components are also possible, as will be readily appreciated.

Figure 4:
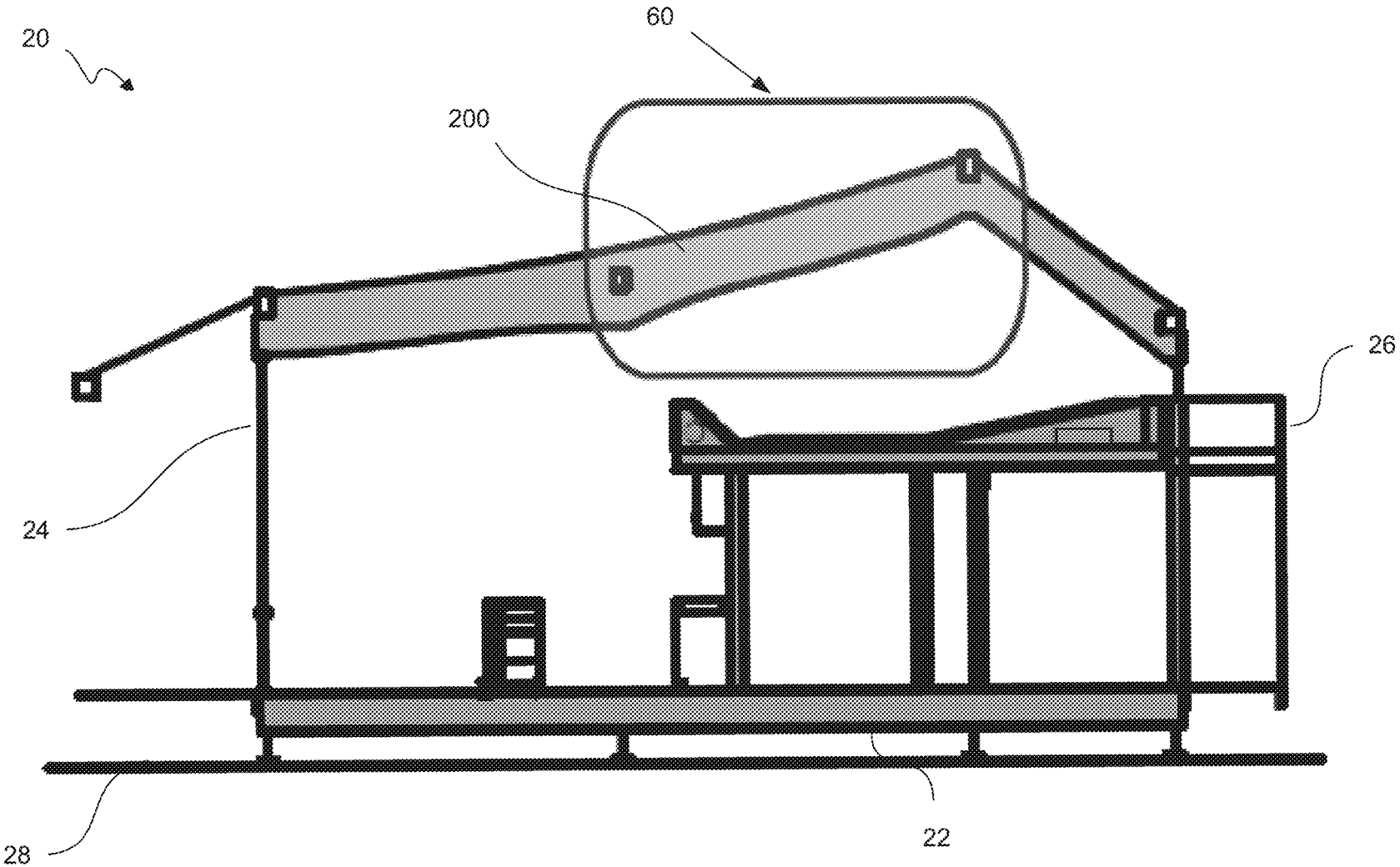
FIG. 4 illustrates in side cross-section view an example overall building structure having a lightweight building assembly within a roof region according to one embodiment of the present disclosure.

Turning next to FIG. 4, an example overall building structure having a lightweight building assembly within a roof region is illustrated in side cross-section view. Similar to the foregoing example, overall building structure 20 can include various well-known structural features, such as, for example, a floor 22, a one or more walls 24, one or more doors 26, and an outside porch 28 or other similar element, among other structural features. Overall building structure 20 can also include one or more roofs 200 or roof regions. Such roofs 200 or roof regions can be integrally formed with one or more walls in some arrangements. Roof 200 is shown within highlighted region 60, which will be discussed in greater detail below with respect to FIG. 5.

Figure 5:
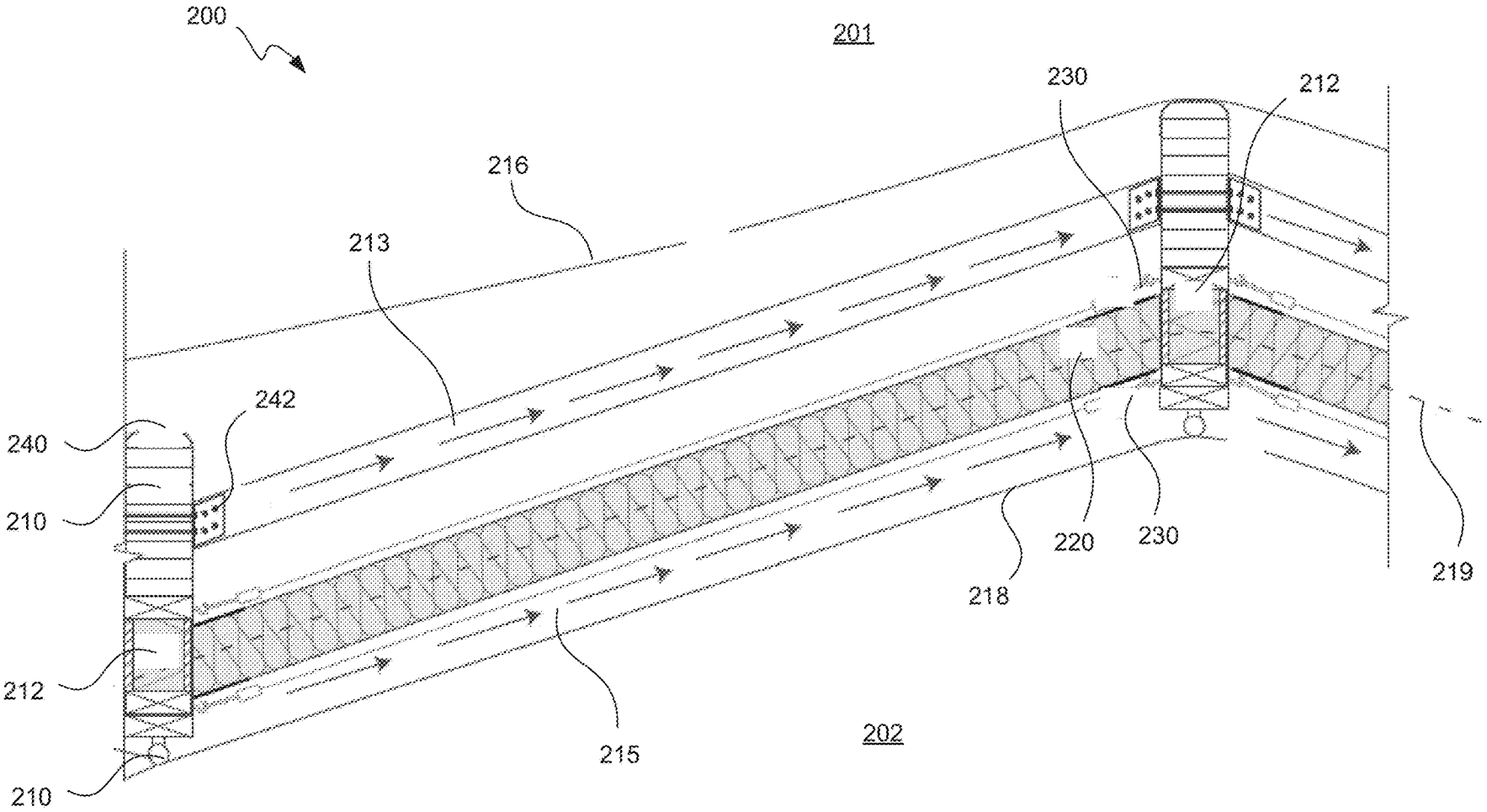
FIG. 5 illustrates in side cross-section view an example roof region of the overall structure of FIG. 4 according to one embodiment of the present disclosure.

Continuing with FIG. 5 an example roof region of the overall structure of FIG. 4 is shown in side cross-section view. As shown, roof region 200 can be arranged atop an overall building structure such that there is a building exterior region 201 and a building interior region 202. In various arrangements, one or more roof regions 200 can be integrally formed with one or more wall regions to form a combined roof and wall lightweight building assembly Similar to wall region 100 above, roof region 200 can form a lightweight building assembly having many of the same or similar components. Roof region 200 can include, for example, frame 210, insulation base 212, and insulation blanket 220, which can similarly have insulation material sealed inside insulation blanket membrane. Insulation blanket 220 can define an insulation blanket axis 219 about which the insulation blanket is configured to rotate. First membrane 216 can be disposed at an exterior region of the lightweight building assembly, while second membrane 218 can be disposed at an interior region of the lightweight building assembly. A plurality of tensioned elements 230 can couple to insulation base 212 and can function to hold insulation blanket 220 in place and provide overall rigidity, structure, and shape to the lightweight building assembly. Similar ventilation channels can provide airflow about the assembly, and can include, for example, a first ventilation channel 213 toward the exterior of the lightweight building assembly and a second ventilation channel 215 toward the interior of the lightweight building assembly, as shown. Additional components can include a protective tape 240 on frame 210, and structural bracing 242 between frame elements.

Figure 6:
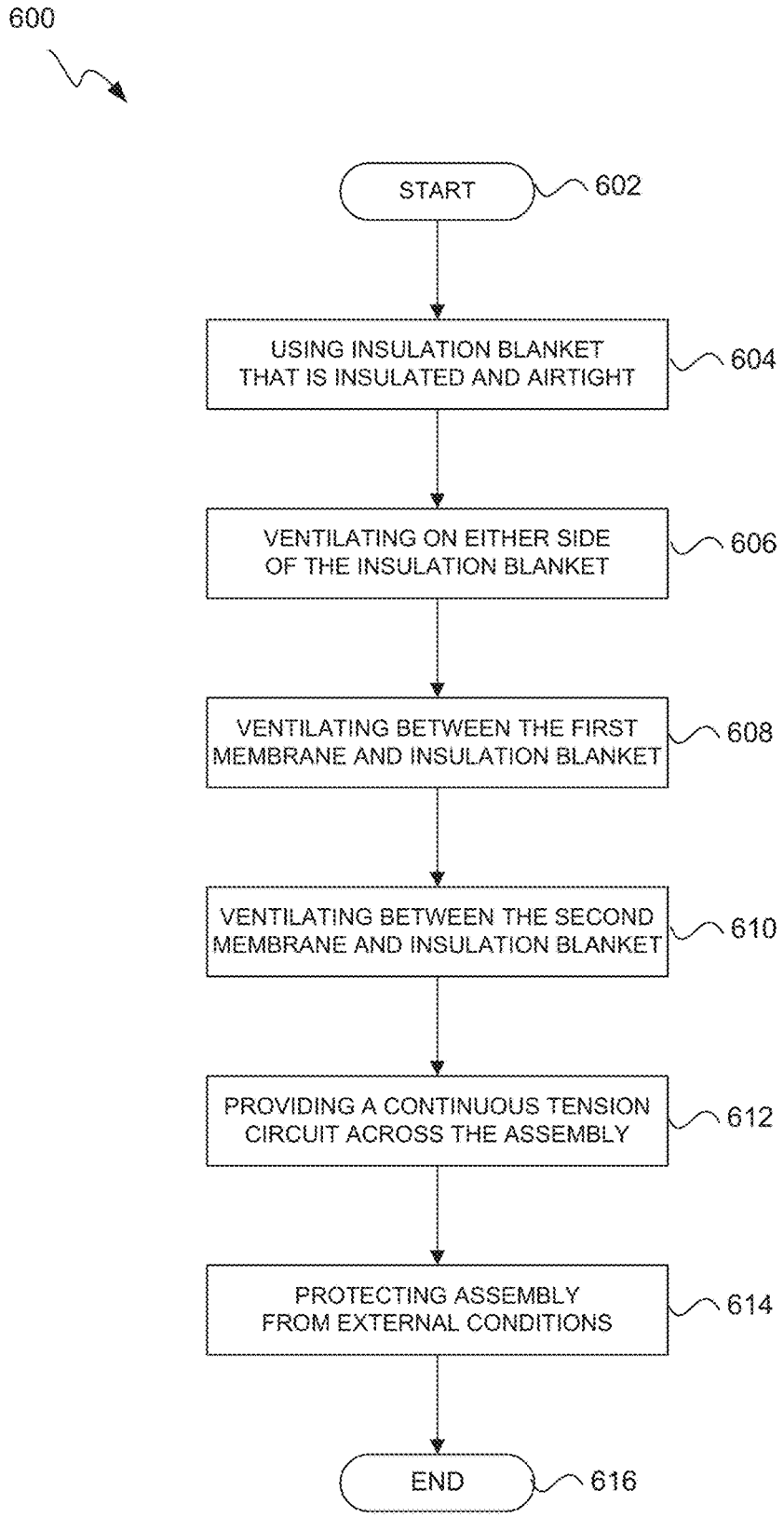
FIG. 6 illustrates a flowchart of an example method of operating a lightweight building assembly according to one embodiment of the present disclosure.

FIG. 6 illustrates a flowchart of an example method of operating a lightweight building assembly. In various embodiments, method 600 can be applied using the various systems, devices, and features provided above. After a start step 602, a first process step 604 can involve using an insulation blanket that is insulated and airtight. This can involve having an insulation blanket having a membrane and/or other suitable component or components that surround the insulation blanket and form an airtight seal around the insulation blanket. Leveraging the use of a sealed and airtight insulation blanket can facilitate a better performance of one or more of the following steps, such as the following ventilation steps.

At the next process step 606, ventilating can take place on either side of an insulation blanket within the lightweight building assembly. This can involve providing an airflow along one or both sides of the insulation blanket.

At the next process step 608, ventilating can take place between a first membrane of the lightweight building assembly and the insulation blanket. As detailed above, the first membrane can be disposed at an exterior region of the lightweight building assembly, such that ventilating step 606 can involve providing an airflow along an exterior region of the insulation blanket and overall lightweight building assembly.

At the next process step 610, ventilating can take place between a second membrane of the lightweight building assembly and the insulation blanket. Again, the second membrane can be located at an interior region of the lightweight building assembly, such that ventilating step 608 can involve providing an airflow along an interior region of the insulation blanket and overall lightweight building assembly.

At the next process step 612, a continuous tension circuit can be provided across the lightweight building assembly. This can involve a plurality of tensioned members coupled to an insulation base of the assembly and pulled tight to provide the tension.

At the next process step 614, the lightweight building assembly can be protected from various external conditions. Such conditions external to the lightweight building assembly can include conditions and elements both outside and inside the building structure of which the assembly is a part. For example, moisture can be wicked away from one or membranes of the lightweight building assembly, which can include the first and second membranes. This can be accomplished through the use of a nonpermeable material for the membranes, which can be coated with a material to facilitate moisture wicking. Such a material can be aluminum based, for example, although other materials can also be used. Such moisture wicking can take place at one or more membranes and involve moisture at one or more surfaces both inside and outside the lightweight building assembly and associated building structure.

Another example of protecting against external conditions can involve protecting the lightweight building assembly from things outside the lightweight building assembly and associated building structure, such as heat, cold, rain, wind, other weather conditions and other external items that may be damaging to the assembly. Other features and functions of the lightweight building assembly as disclosed herein can also be part of the step of protecting against external conditions. The method then ends at end step 616.

It will be appreciated that the foregoing method 600 may include additional steps not shown, and that not all steps are necessary in some embodiments. For example, additional steps may include the use of sensors to monitor and detect building performance and conditions, among other possible steps. Furthermore, the order of steps may be altered as desired, and one or more steps may be performed simultaneously. For example, all of process steps 604-614 can be performed simultaneously, and can be continuously performed. Other process steps, details, and arrangements are also possible.

Figure 7:
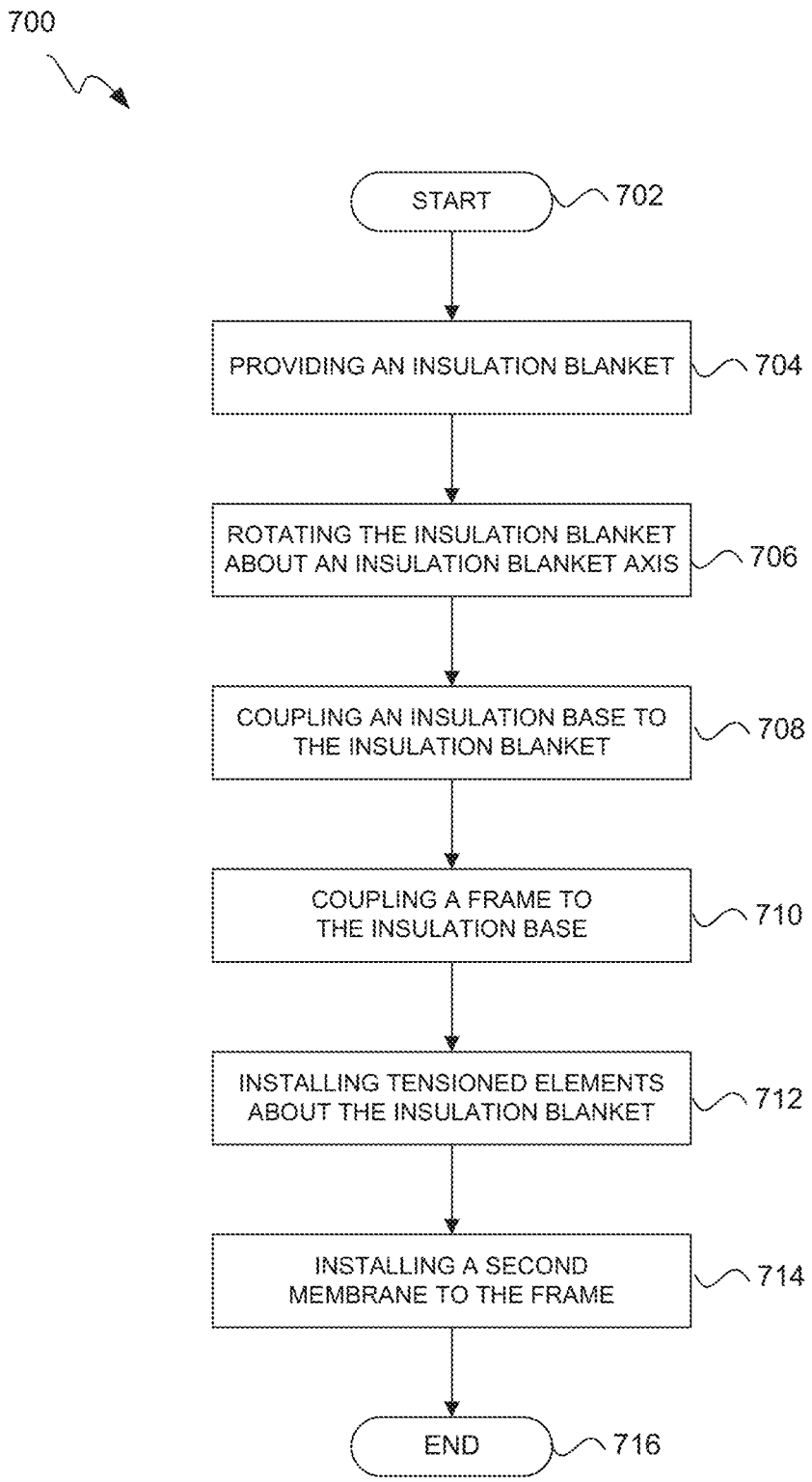
FIG. 7 illustrates a flowchart of an example method of installing a lightweight building assembly according to one embodiment of the present disclosure.

Lastly, FIG. 7 illustrates a flowchart of an example method of installing a lightweight building assembly. In various embodiments, method 700 can be applied using the various systems, devices, and features provided above. After a start step 702, a first process step 704 can involve providing an insulation blanket. Such an insulation blanket can be a preformed structure having an insulation material sealed within a nonpermeable membrane for example. Other details regarding this insulation blanket are provided above.

At the next process step 706, the insulation blanket can be rotated about an insulation blanket axis. This can be done to shape the insulation blanket into a variety of different shapes, such as a straight shape or a parabolic or other curved shape, as noted above. Such a shape can then form the basis of the overall shape of the lightweight building structure.

At a following process step 708, an insulation base can be coupled to the insulation blanket. This can involve fastening the insulation blanket to blocks or other suitable components of the insulation base. The insulation base can have a first membrane that is nonpermeable to prevent moisture from passing therethrough.

At the next process step 710, a frame can be coupled to the insulation base. Such a frame can provide an overall structure for the lightweight building assembly that all assembly components are contained within or about.

At a following process step 712, a plurality of tensioned elements can be installed about the insulation blanket. This can involve fastening or otherwise coupling the tensioned elements to the insulation base, such as at blocks of the insulation base. The tensioned elements can have slack or otherwise be loose upon initial coupling and can then be pulled tight to provide tension across the lightweight building assembly, similar to a corset arrangement.

At subsequent process step 714, a second membrane can be installed to the frame. This second membrane can cover the insulation blanket and tensioned elements to provide an aesthetically pleasing surface to the interior region of the lightweight building assembly. The method then ends at end step 716.

It will be appreciated that the foregoing method 700 may include additional steps not shown, and that not all steps are necessary in some embodiments. For example, additional steps may include compressing or expanding the lightweight building assembly using the tensioned elements. Other process steps can involve shaping the lightweight building assembly, such as in a straight line or along any of a variety of curves. Also, the order of steps may be altered as desired, and one or more steps may be performed simultaneously. For example, step 708 may be performed prior to steps 704 and 706. As another example, one or more of process steps 704-708 can be performed simultaneously. Other process steps, details, and arrangements as will be readily appreciated.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. A lightweight building assembly, comprising:

an insulation blanket defining an insulation blanket axis about which the insulation blanket is configured to rotate, the insulation blanket having a peripheral wall portion positioned at a radial distance from the insulation blanket axis, wherein the radial distance varies along a length of the insulation blanket axis;

an insulation base coupled to and configured to support the insulation blanket, the insulation base having a first membrane;

a frame coupled to and configured to support the insulation base, the frame having a second membrane, wherein the frame is configured to move with respect to the insulation base; and a plurality of tensioned elements situated about the insulation blanket, wherein each of the plurality of tensioned elements extends tangentially from the peripheral wall portion of the insulation blanket to the second membrane, and wherein the plurality of tensioned elements combine to form a continuous tension circuit across the lightweight building assembly.

2. The lightweight building assembly of claim 1, wherein the lightweight building assembly is configured to be effective in multiple disparate climates.

3. The lightweight building assembly of claim 2, wherein the multiple disparate climates include an arid climate, a humid climate, a hot climate, a cold climate, and a hurricane zone.

4. The lightweight building assembly of claim 1, wherein the insulation blanket includes an insulation material wrapped in a sealed membrane.

5. The lightweight building assembly of claim 4, wherein the sealed membrane is aluminum based.

6. The lightweight building assembly of claim 1, wherein the insulation base includes an insulation material wrapped in a sealed membrane.

7. The lightweight building assembly of claim 6, wherein the sealed membrane is aluminum based.

8. The lightweight building assembly of claim 1, wherein the first membrane is weatherproof and fire rated.

9. The lightweight building assembly of claim 1, wherein the second membrane includes a vapor opening and is fire rated.

10. The lightweight building assembly of claim 1, wherein the plurality of tensioned elements are woven ratchet straps.

11. The lightweight building assembly of claim 1, wherein the plurality of tensioned elements are coupled to the insulation base.

12. The lightweight building assembly of claim 1, wherein a first ventilation channel is formed between the first membrane and the insulation blanket.

13. The lightweight building assembly of claim 12, wherein a second ventilation channel is formed between the second membrane and the insulation blanket.

14. A method of operating a lightweight building assembly, the method comprising:

ventilating on either side of an insulation blanket of the lightweight building assembly, wherein the lightweight building assembly includes the insulation blanket, which defines an insulation blanket axis about which the insulation blanket is configured to rotate, the insulation blanket having a peripheral wall portion positioned at a radial distance from the insulation blanket axis, wherein the radial distance varies along a length of the insulation blanket axis, an insulation base coupled to and configured to support the insulation blanket, the insulation base having a first membrane, a frame coupled to and configured to support the insulation base, the frame having a second membrane, wherein the frame is configured to move with respect to the insulation base, and a plurality of tensioned elements wound about the insulation blanket, wherein each of the plurality of tensioned elements extends tangentially from the peripheral wall portion of the insulation blanket to the second membrane;

ventilating between the first membrane and the insulation blanket; and ventilating between the second membrane and the insulation blanket.

15. The method of claim 14, wherein one or more of the ventilating steps involves the use of a fan, a wall shape, an airfoil, and/or an electrical current to facilitate airflow.

16. The method of claim 14, further including the steps of:

using the insulation blanket, wherein the insulation blanket is insulated and airtight;

providing a continuous tension circuit across the lightweight building assembly; and protecting the lightweight building assembly from external conditions.

17. A method of installing a lightweight building assembly within an overall building structure, the method comprising:

providing an insulation blanket, the insulation blanket defining an insulation blanket axis about which the insulation blanket is configured to rotate, the insulation blanket having a peripheral wall portion positioned at a radial distance from the insulation blanket axis, wherein the radial distance is configured to vary along a length of the insulation blanket axis;

coupling an insulation base having a first membrane to the insulation blanket;

coupling a frame to the insulation base such that the frame is configured to move with respect to the insulation base;

installing a plurality of tensioned elements about the insulation blanket such that each of the plurality of tensioned elements extends tangentially from the peripheral wall portion of the insulation blanket; and installing a second membrane to the frame such that the second membrane is at a distance above a floor of the overall building structure.

18. The method of claim 17, wherein the plurality of tensioned elements combine to form a continuous tension circuit across the lightweight building assembly.

19. The method of claim 17, wherein the lightweight building assembly is configured to be effective in multiple disparate climates.

20. The method of claim 17, wherein installing the plurality of tensioned elements involves coupling the tensioned elements to the insulation base.

21. The method of claim 17, further including the step of:

rotating the insulation blanket about an insulation blanket axis.

* * * * *